United States Patent [19]

Lauener et al.

[11] Patent Number: 4,850,546

[45] Date of Patent: Jul. 25, 1989

[54] APPRATUS AND METHOD FOR REELING UP STRIPS

[75] Inventors: Wilhelm F. Lauener, Gerlafingen; Rolf Würgler, Esslingen, both of Switzerland

[73] Assignee: Lauener Engineering AG, Thun, Switzerland

[21] Appl. No.: 710,475

[22] Filed: Mar. 11, 1985

Related U.S. Application Data

[62] Division of Ser. No. 527,227, Aug. 25, 1983.

[30] Foreign Application Priority Data

Sep. 16, 1982 [CH] Switzerland ..... 5478/82

[51] Int. Cl.[4] ..... B65H 19/30

[52] U.S. Cl. ..... 242/79; 242/81

[58] Field of Search ..... 242/78.1, 79, 81, 84, 242/72 R, 74

[56] References Cited

U.S. PATENT DOCUMENTS

| | | | |
|---|---|---|---|
| 2,056,071 | 9/1936 | Moore | 242/74 X |
| 2,256,975 | 9/1941 | Eddy et al. | 242/81 |
| 2,561,543 | 7/1951 | Teplitz | 242/79 |
| 2,586,376 | 2/1952 | Picton | 242/81 |
| 2,663,512 | 12/1953 | Erhardt | 242/72 X |
| 2,829,845 | 4/1958 | Loop | 242/81 |
| 3,042,335 | 7/1962 | Ensign et al. | 242/81 |
| 3,527,425 | 9/1970 | Schumaker | 242/78.1 |
| 3,718,303 | 2/1973 | Mount et al. | 242/81 |
| 3,796,389 | 3/1974 | Nishiyori et al. | 242/78.1 X |
| 4,210,294 | 7/1980 | Jansen | 242/78.1 X |

*Primary Examiner*—John M. Jillions

*Attorney, Agent, or Firm*—Sheridan, Ross & McIntosh

[57] ABSTRACT

An apparatus for reeling up strips, especially aluminum strips produced in a rolling casting plant, comprises a reel arranged axially rotatable by a drive in a path of the strip. This reel in the position for use is disengageably connected with the drive arranged on one side of the strip path and fixedly connected with a carriage frame arranged on the other side of the strip path. With the carriage frame the reel can be drawn out of the strip path. Close to the reel there is mounted a coil stripper provided with a drive.

4 Claims, 2 Drawing Sheets

APPRATUS AND METHOD FOR REELING UP STRIPS

CROSS-REFERENCE TO RELATED APPLICATION

This application is a division of U.S. patent application Ser. No. 527,227, Filed Aug. 25, 1983.

BACKGROUND OF THE INVENTION

The invention relates to an apparatus for reeling up strips, especially aluminum strips produced in a rolling-casting plant, with a reel axially rotatable by a drive and arranged in a path of the strip, and to a method for this purpose.

Ordinarily after a rolling-casting plant there is arranged a stationary reel which is moved by a special reduction gear. The strip reeled into a coil is ejected laterally of the strip path by a coil ejector and there taken over by a coil truck. This arrangement has the disadvantage that considerable space is occupied laterally of the strip path and the casting line for the coil removal. Moreover expensive special gears are necessary which are capable of taking up the reel mounting.

The inventor has set himself the target of producing an apparatus and a method of the above-stated kind by which especially space is saved and the use of ordinary gears is rendered possible.

SUMMARY OF THE INVENTION

An apparatus has now been found which leads to the solution of the problem. In this apparatus the reel, in the position for use, is connected disengageably with the drive system arranged on one side of the strip path and fixedly with a carriage frame arranged on the other side of the strip path, with which frame the reel can be conducted out of the strip path. This signifies that the strip reeled into a coil is not ejected out of the strip path but remains in the strip path due to the withdrawal of the reel, and is there taken up by the coil truck. According to the invention this coil truck is likewise arranged between the drive and the carriage frame and transports the reeled strip away in the strip direction. Thus in this arrangement troublesome equipment is no longer to be found laterally of the strip line.

BRIEF DESCRIPTION OF THE DRAWINGS

Further advantages, features and details of the invention appear from the following description of a preferred example of embodiment and by reference to the drawings, wherein.

DETAILED DESCRIPTION

Figure 1:
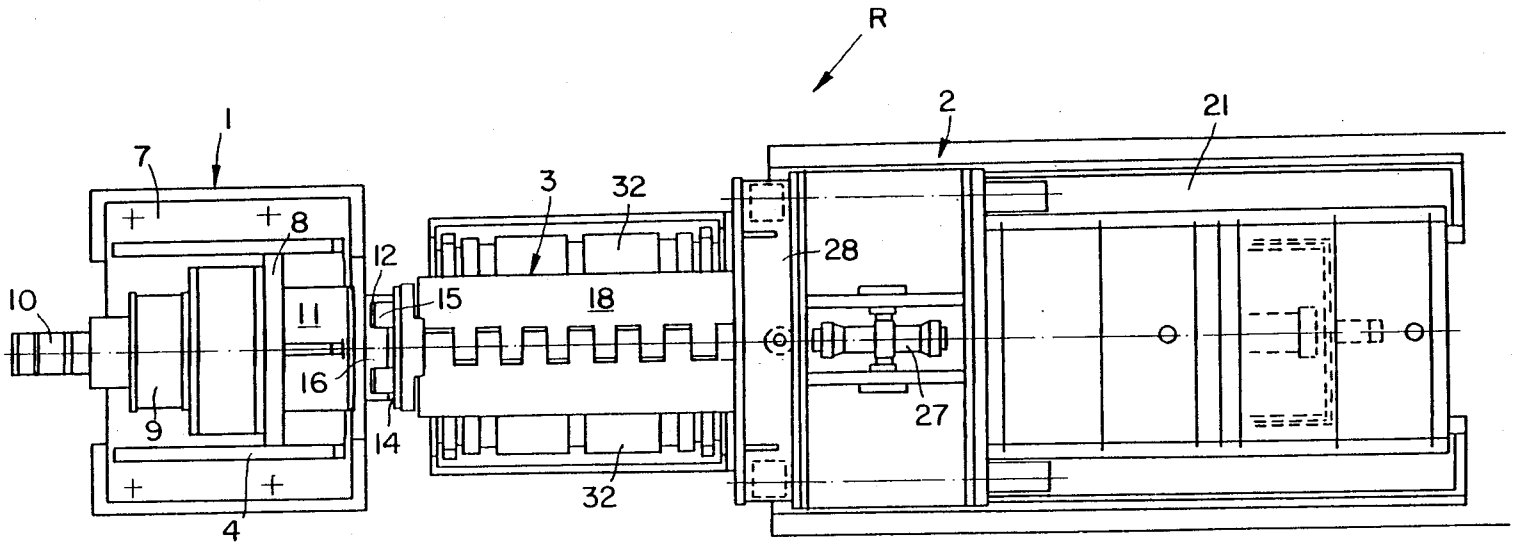
FIG. 1 shows a plan view of an apparatus for reeling up for example aluminum strip.

The drive of the reel is preferably effected by a direct-current motor or by a hydraulically driven motor. These are slow-running motors so that a simple, conventional planetary gearing can follow them. Following the planetary gearing the drive has engaging pieces on one end face which engage in the position for use between projections arranged on an end face of the reel. Thus the reel can be disengaged from the drive in a very simple manner.

The carriage frame is situated in a housing and is preferably moved by means of a hydraulic drive system approximately at a right angle to the strip path. A shaft connected with the reel and the bearing devices necessary for this rest on the carriage frame.

In order to insure that the reeled strip is held in the strip path when the reel is drawn back into the housing, the invention provides a coil stripper close to the reel. This can consist of a simple plate which may grasp partly around the reel. Preferably however in addition to this simple plate a further plate, movable by a hydraulic drive system, will be arranged in the vicinity of the reel, by means of which the removal position of the coil can be adjusted better.

So that stripping off of the coil from the reel is made possible at all, the reel too must be of special formation. In accordance with the invention the reel has on its circumferential surface a slot extending parallel with its longitudinal axis and serving to receive the strip at the commencement of reeling. The size of the slot can be modified and adapted to the strip thickness by spreader elements arranged on the other side of the slot on the circumferential surface of the reel.

The invention further includes a method for the reeling of strips in which the reeled strip is stripped from the reel. In accordance with the method of the present invention, the reel is disengaged from the drive and is guided out of the strip path. In addition, at the same time the reeled-up strip is held by a strip stripper in the strip path, and the reeled-up strip is transported away in the strip path direction by a coil truck.

Specifically referring to the drawings, in an apparatus R for the reeling for example of aluminum strip, which as a rule is placed after a rolling casting plant (not shown), a reel 3 is mounted between a drive unit 1 and a reel carrier 2.

The drive unit 1 consists of two L-shaped profiled bars 4 which are set upon a carrier plate 7 connected through H-girders 5 with a foundation 6 and are connected by a cross bar 8. This cross bar 8 carries on the one hand a planetary gear 9 with a motor 10 and on the other hand a shaft part 11 which rests with its end face 12 upon an end face 14 of the reel 3 in the position for use. Both end faces 12 and 14 have engaging pieces 15 and 16 which engage between one another and thus serve as engaging members.

Reel 3 includes a slot 17 parallel with its axis on its circumferential surface 18 to receive one end of the strip. The size of the slot 17 is variable.

Figure 2:
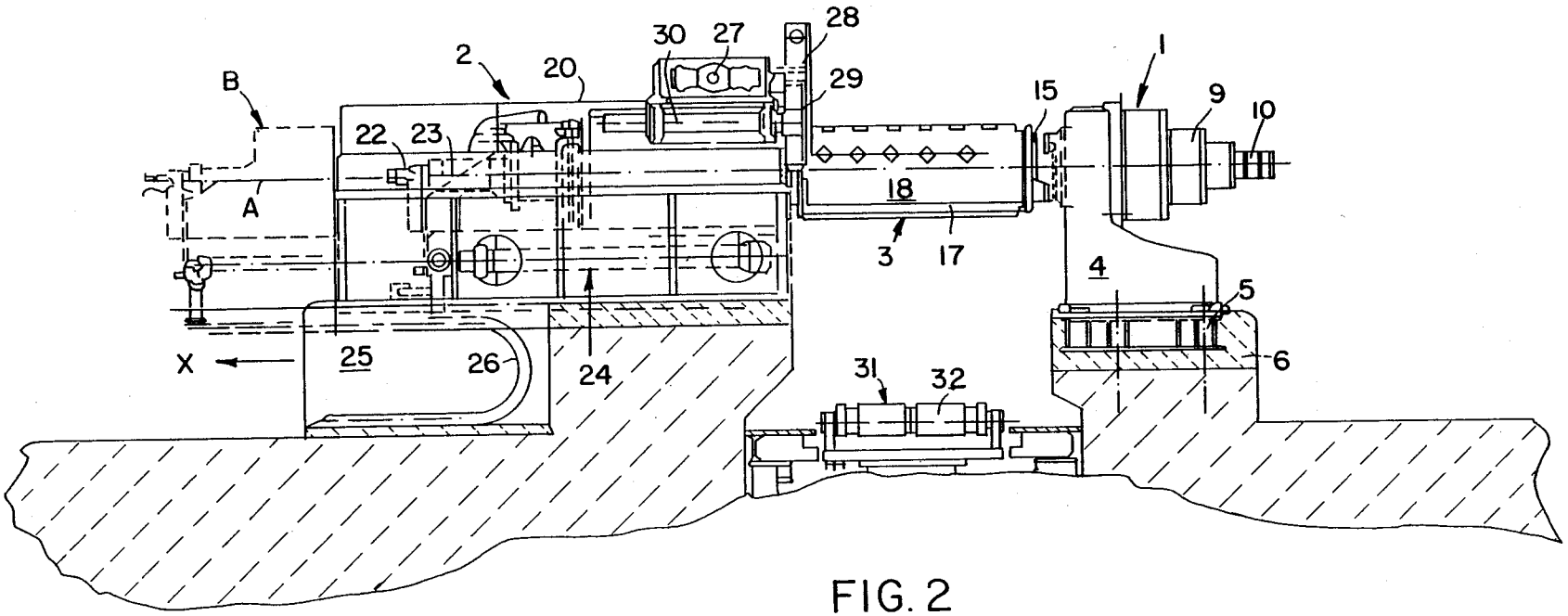
FIG. 2 shows a partially sectional lateral elevation, represented on a reduced scale, of the apparatus according to FIG. 1.

Opposite to the end face 14 the reel 3 is connected with a carriage frame 20 which is mounted in a housing 21. This carriage frame comprises a shaft 22, represented in dashed lines in FIG. 2, in the axial direction A connected with the reel 3, and the necessary bearing mountings 23.

By means of a pneumatically or hydraulically operated cylinder-piston system 24 the carriage can be moved in the direction X and thus the reel can be drawn back into the housing 21. The end position B of the carriage 20 is represented in dashed lines in FIG. 2. Beneath the housing 21 there is a guide box 25 for various control cables 26.

On the housing 21 there is further seated a likewise pneumatically or hydraulically operable drive 27 for a stripper 28 to hold the reeled strip in position while the reel 3 is moved in the direction X and is drawn back into housing 21 out of the coil of reeled strip. In the rest position the stripper 28 lies against a further plate 29 which is held likewise in the housing 21 by means of bolts or guide pieces 30.

The coil of reeled strip free from reel 3, is held between stripper 28 and drive 1. The coil truck 31, which extends beneath reel 3 and the reeled-up coil, receives the reeled-up coil (not shown) between two roller bearings or supporting rolls 32, for transportation away from the assembly to the strip path direction.

What is claimed is:

1. Method for reeling up strips which comprises:

moving said strip in a strip path;

providing a reel having first and second ends and being rotatable about an axis parallel with the strip path, said reel including means for attaching an end of the strip;

providing drive means for rotating the reel, said drive means being disengageably connected to said first reel end;

reeling up the strip on said reel to form a coil of strip on said reel providing a carriage frame fixedly connected to said second end of said reel , said carriage frame being arranged on the side of the strip path opposed to said drive means and adapted to conduct said reel in or out of the strip path;

providing a housing for mounting said carriage frame;

providing a coil stripper mounted on said housing on the side of the strip path opposed to said drive means , said coil stripper having stripper drive means associated therewith;

moving said coil stripper to engage a portion of the coil;

holding the coil in the strip path between said coil stripper and said drive means;

conducting said reel out of the strip path and into the housing; and stripping the coil off the reel as the reel is conducted out of the strip path and into said housing.

2. Method according to claim 1 for reeling up aluminum strip produced in a rolling casting plant.

3. Method according to claim 1 wherein the reeled up strip is held in the strip path at the same time as the reel is guided away from the strip path.

4. Method according to claim 1 wherein the reeled up strip is transported away in the strip path direction.

* * * * *